United States Patent [19]

Johnsen

[11] 4,039,122

[45] Aug. 2, 1977

[54] CONTINUOUS BUSINESS FORM OR THE LIKE ADAPTED FOR SUBSEQUENT PROCESSING INTO ORIGINAL INDICIA BEARING LOTTERY TICKETS, ENVELOPES OR THE LIKE

[76] Inventor: Edward L. Johnsen, 12 Fox Meadow Lane, Wayland, Mass. 01778

[21] Appl. No.: 619,511

[22] Filed: Oct. 3, 1975

Related U.S. Application Data

[62] Division of Ser. No. 433,464, Jan. 15, 1974, Pat. No. 3,956,049.

[51] Int. Cl.[2] ..... B65D 27/10

[52] U.S. Cl. ..... 229/69; 282/11.5 A

[58] Field of Search ..... 229/69, 92.1, 92.3, 229/73; 282/11.5 A, 25

[56] References Cited

U.S. PATENT DOCUMENTS

| | | | |
|---|---|---|---|
| 1,708,574 | 4/1929 | Hazen | 229/92.3 |
| 3,312,385 | 4/1967 | Amort | 229/73 |
| 3,419,286 | 12/1968 | Noonan et al. | 229/69 X |
| 3,428,237 | 2/1969 | Dowen | 229/69 |
| 3,902,655 | 9/1975 | Huffman | 229/69 |

FOREIGN PATENT DOCUMENTS

| | | | |
|---|---|---|---|
| 1,484,517 | 6/1967 | France | 229/69 |

*Primary Examiner*—Stephen P. Garbe
*Attorney, Agent, or Firm*—J. Warren Kinney, Jr.

[57] ABSTRACT

A continuous business form which includes a series of connected blanks adapted to be subsequently processed into multi-ply lottery tickets, envelopes or like articles, is produced from an endless web of sheet material. Each blank is developed from an odd number of continuous panels which span the width of the web wherein adjacent, non-abutting panels define the various plies of each article, and wherein one surface of certain of the nonabutting panels is provided with an adhesive which is not activated for adhering to other panels of the form until after original indicia has been applied to the non-abutting panels which are thereafter superposed in overlying relationship for producing the continuous series of multi-ply forms wherein each ply contains original, directly applied indicia.

16 Claims, 32 Drawing Figures

THE INSTANT GAME
1 ONE
2 TWO
5 FIVE
3 THREE
6 SIX
4 FOUR
9 NINE
VOID

FIG-11
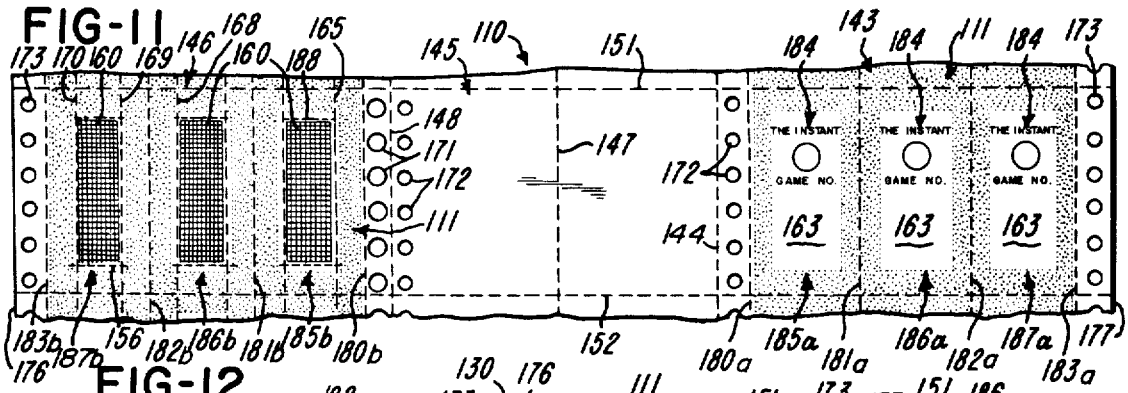
FIG-12
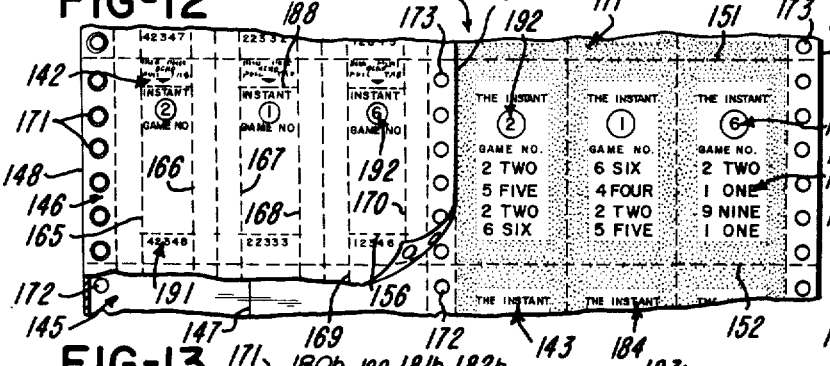
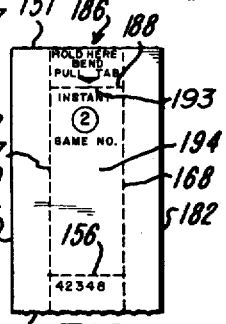
FIG-14
FIG-13
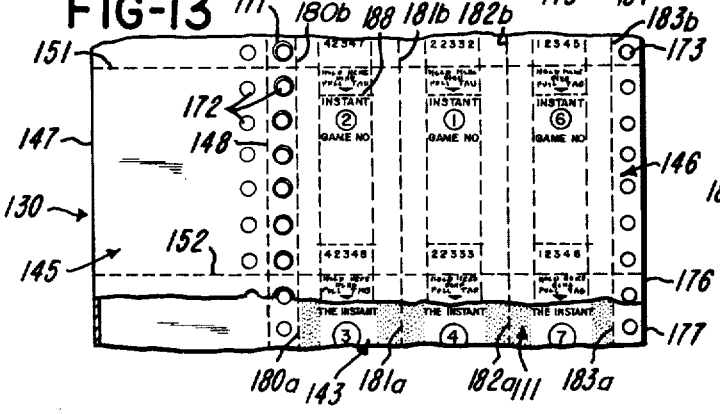
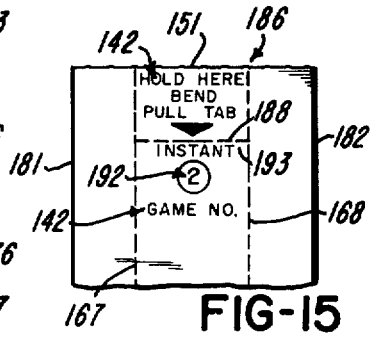
FIG-15
FIG-16
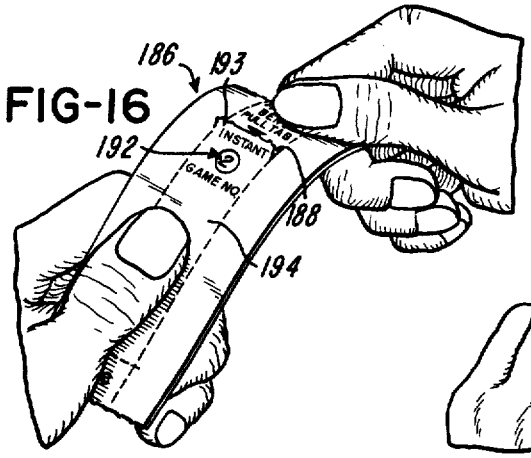
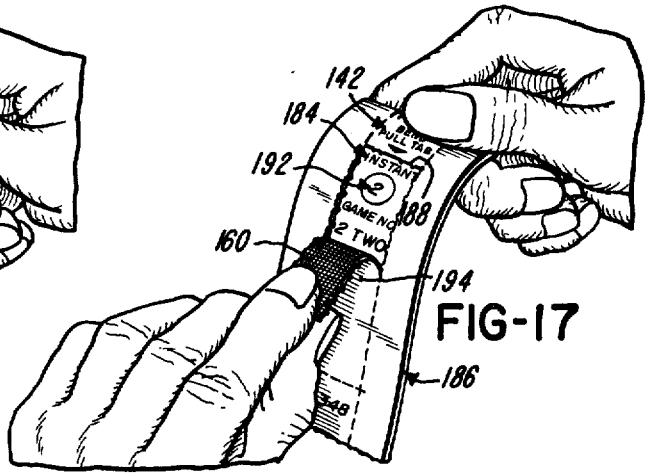
FIG-17

FIG-18
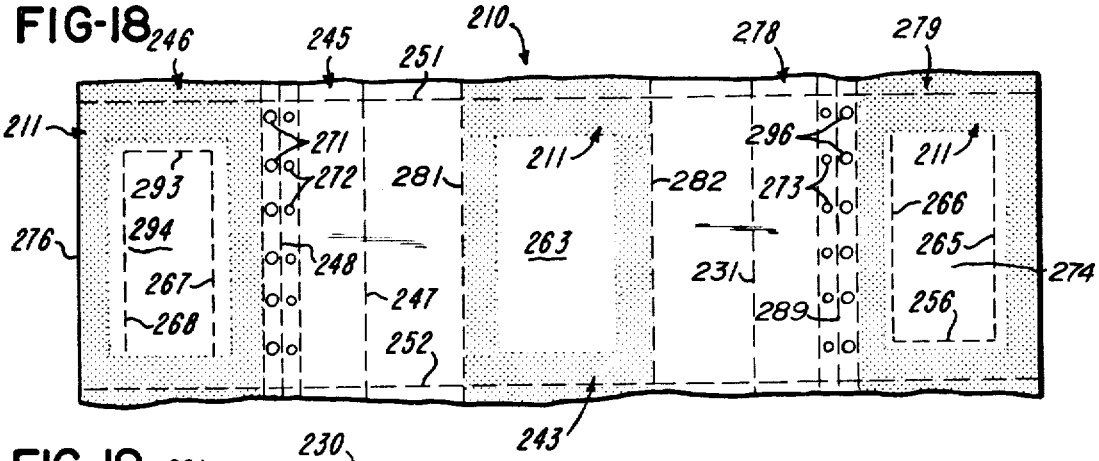
FIG-19
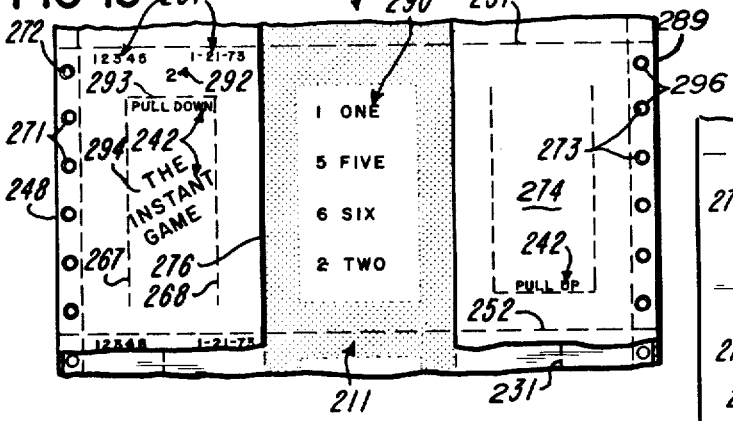
FIG-21
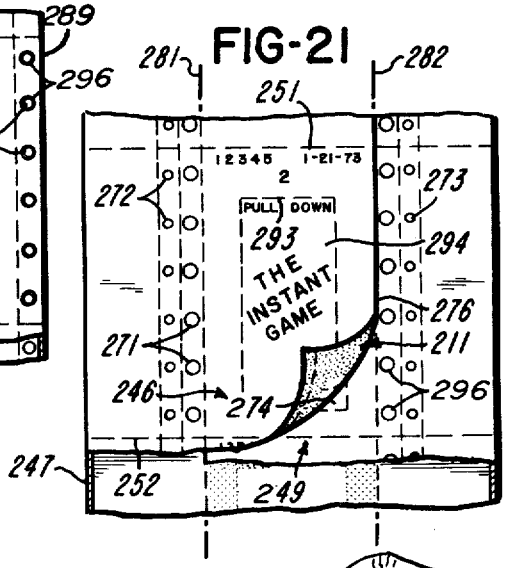
FIG-20
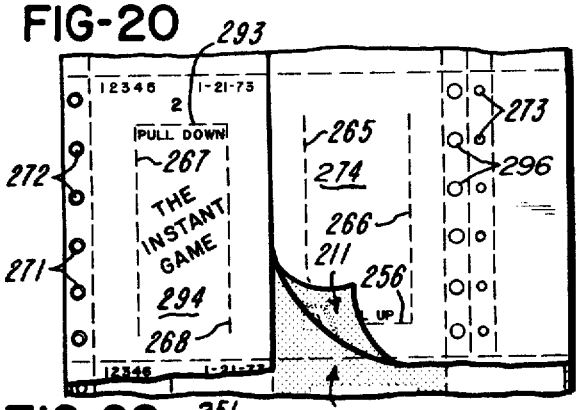
FIG-22
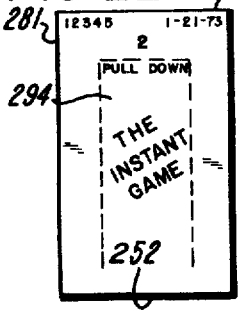
FIG-23
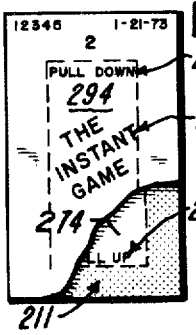
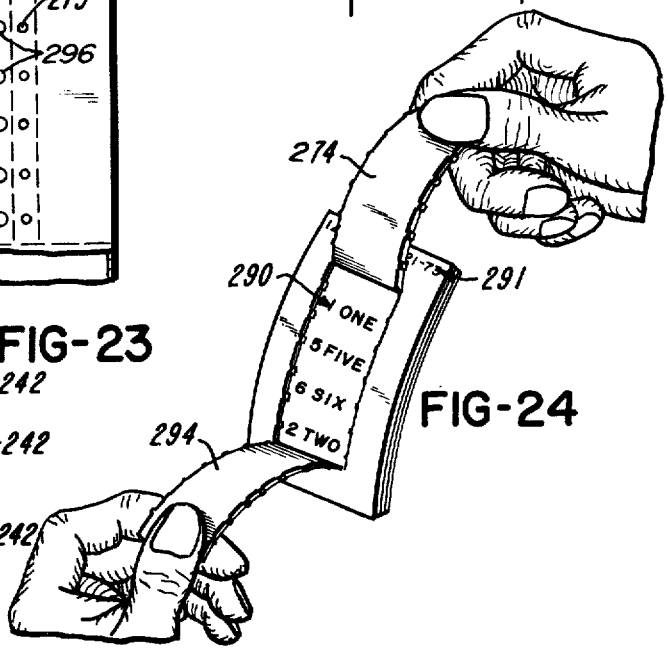
FIG-24

CONTINUOUS BUSINESS FORM OR THE LIKE ADAPTED FOR SUBSEQUENT PROCESSING INTO ORIGINAL INDICIA BEARING LOTTERY TICKETS, ENVELOPES OR THE LIKE

CROSS REFERENCE TO RELATED APPLICATIONS

My patent application, Ser. No. 433,464, now U.S. Pat. No. 3,956,049, of which this is a division, was co-pending with my patent applications, Ser. Nos. 433,463, now abandoned,, 433,462, now abandoned and 433,461 (now US. Pat. No. 3,940,124), filed Jan. 15, 1974, each of which disclosed a particular genus of continuous business forms, the resulting articles, and corresponding methods of manufacture.

The first mentioned application discloses a form wherein original indicia may be applied directly to an under ply of an article formed from a continuous web having two contiguous longitudinally extending co-planar panels, comprising a cover ply panel and an under ply panel of a multi-ply article, wherein the cover ply panel is disposed in substantial overlying relationship with the under ply panel exposing a portion of and concealing a portion of the original indicia contained thereon.

U.S. Pat. No. 3,940,124 discloses a form wherein original indicia may be applied directly to common surfaces of cover ply and under ply panels of a continuous series of articles utilizing an article blank having three transversely spaced contiguous co-planar panels each defining one ply of the article wherein the various panels are adapted to be accordion folded into registered zig-zag relationship, thereby producing a multi-ply lottery ticket or the like.

Application Ser. No. 433,452 utilizes the teachings of either the present application or those of U.S. Pat. No. 3,940,124 a plurality of continuous webs into registered overlying relationship for producing a series of stuffed, sealed envelopes or the like which include an attached return envelope form.

BACKGROUND OF THE INVENTION

1. Field of the Invention.

The inventon is directed to business forms, particularly a continuous form which comprises a series of connected blanks suited for subsequent processing into multi-ply lottery tickets, envelopes or the like which contain only original indicia on one or more of the plies. As used herein the term "original indicia" excludes preprinted indicia and indicia applied by transfer means such as carbon paper, and the like. Each blank comprises an article such as a lottery ticket, envelope or the like having at least two plies disposed in overlying, superposed relationship wherein a portion of the top ply is permanently secured to a portion of the bottom ply to form a sealed pocket therebetween and wherein original, directly applied indicia is contained on the exposed surface of at least one ply and the concealed surface of at least one ply, the concealed indicia being exposable through access to said sealed pocket.

2. Description of the Prior Art

A number of patents have issued disclosing a variety of articles of multi-ply construction having an interior, exposable pocket for containing concealed indicia, such as with lottery tickets, mailing envelopes or the like. However, the previous embodiments do not disclose a continuous web adapted for the production of both envelopes and lottery tickets while maintaining a desirable degree of secrecy and/or while permitting the application of original, directly applied indicia to both the interior surface of the pocket and to the exterior face of the article.

The prior art, as it relates to lottery tickets is present in two different formats. The first format includes orginal indicia in a concealed pocket having acceptable tamperproof features as exemplified in U.S. Pat. Nos. 1,983,004; 2,108,749; and 2,180,808. Each of these patents disclose a lottery ticket having original indicia on one panel which is concealed by another panel in overlying relationship therewith, the overlying panel being partially or completely removable from the indicia bearing panel to selectively expose the indicia thereon. None of these patents disclose or suggest a lottery ticket capable of being produced by mass production techniques nor do they provide for the simultaneous and direct application of original indicia to both the ticket face and the interior pocket surfaces.

The second ticket format is illustrated in U.S. Pat. 2,023,829 which discloses a lottery ticket which permits mass production, however, the ticket is not acceptable for use in lottery games of the type which require tamper-proof, high security features. As with the first ticket format, there is no provision for the simultaneous application of original, directly applied indicia to both an exterior surface and an interior, concealed surface of the final article.

The prior art as it relates to envelopes is exemplified in U.S. Pat. Nos. 3,104,799; 3,337,120; 3,339,827; 3,482,780; 3,608,816; and 3,701,468. The envelope of U.S. Pat. No. 3,482.780 is adapted to receive original, directly applied indicia to the surface of a concealed pocket but not to the external face thereof. None of the other patents make any provision for application of original indicia to the pocket. While certain of the prior art envelopes appear similar to final form to some of the embodiments of the present invention none of them achieve the basic objective of the present invention, viz, the application of original, directly applied indicia to both the exterior face and the interior surface of the concealed pocket of the final article.

Thus, the prior art as disclosed by these patents falls into two categories. The first category includes articles which contain original, directly applied inidica concealed in the interior pocket of the final article, while the second category includes articles which contain original indicia on the external face of the final article. None of the above patents provide for the simultaneous application of directly applied, original indicia to both the internal pocket and exterior face of a completed article.

SUMMARY OF THE INVENTION

The present invention is directed to a method of producing a series of connected blanks which are particularly suited for subsequent processing into multi-ply lottery tickets, envelopes or the like; to said blanks per se; and to the articles formed therefrom.

A continuous series of blanks are fabricated from an endless web of sheet material, wherein the web is defined by an odd number of continuous panels which collectively span the width thereof. Each blank defines a multi-ply article such as a lottery ticket, envelope, or the like wherein adjacent, non abutting panels of the web define the various article plies. Adhesive is selectively applied to a portion of a surface of an outer or edge-adjacent panel after which the web is longitudinally folded for disposing an edge-adjacent panel onto and in direct, overlying relationship with an intermediate discardable panel and in parallel juxtaposition with an adjacent, non-abutting panel of the web. The adhesive is non-adhereent to or with the surface of the intermediate discardable panel. The exposed surfaces of said folded panel and said non-abutting panel are thus disposed in side-by-side relationship after which the individual blanks of the web are suitably accumulated in interconnected relationship for later use.

When later used, the individual, interconnected blanks are fed through a computer controlled printer, or the like, where original indicia is applied directly to each of the exposed surfaces which collectively constitute a single article blank. The initially folded, indicia bearing panel is disposed in superposed overlying relationship with the said non-abutting indicia bearing panel, a corresponding edge of said indicia bearing panels being interconnected by said intermediate discardable panel. Thereafter, said indicia bearing panels are permanently interconnected by means of adhesive initially applied to at least one outer or edge-adjacent panel, after which the intermediate panel is discarded, thereby completing each article which is then adapted to be severed or otherwise separated from the interconnected articles of the web in the form of a completed lottery ticket, envelope, or the like.

The completed articles contain original indicia on an outer panel and also on the upper surface an inner or interior panel.

It is, therefore, an object of the present invention to provide a method of making a series of interconnected blanks suited for subsequent processing into multi-ply lottery tickets, envelopes or the like having concealed pockets wherein original, directly applied indicia is contained on each of a plurality of superposed plies.

It is further an object of the invention to provide the unique form defining the interconnected blanks.

It is further an object of the invention to provide a family of articles conforming to the various other objectives of the present invention, to wit: a lottery ticket having tamper-proof features for use with games of chance, particularly as utilized and required by state lottery systems, or the like, wherein it is desirable if not necessary that both an interior surface of the pocket of the envelope and an exterior face of the ticket contain original, directly applied indicia; and a mailing envelope which not only contains original, directly applied indicia on a face thereof, but also provides for original, directly applied indicia on an interior surface of the envelope pocket.

Other objects and features of the invention will be readily apparent from the following detailed description.

SUMMARY OF THE DRAWINGS

FIGS. 11–17 illustrate the various steps for producing a second continuous form by the process of FIGS. 1–3 and a lottery ticket obtained therefrom.

FIGS. 18–24 illustrate the various steps for producing a third continuous form by the process of FIGS. 1–3 and a lottery ticket obtained therefrom.

DETAILED DESCRIPTION OF THE DRAWINGS

Figures 1, 2, 3, 3A:
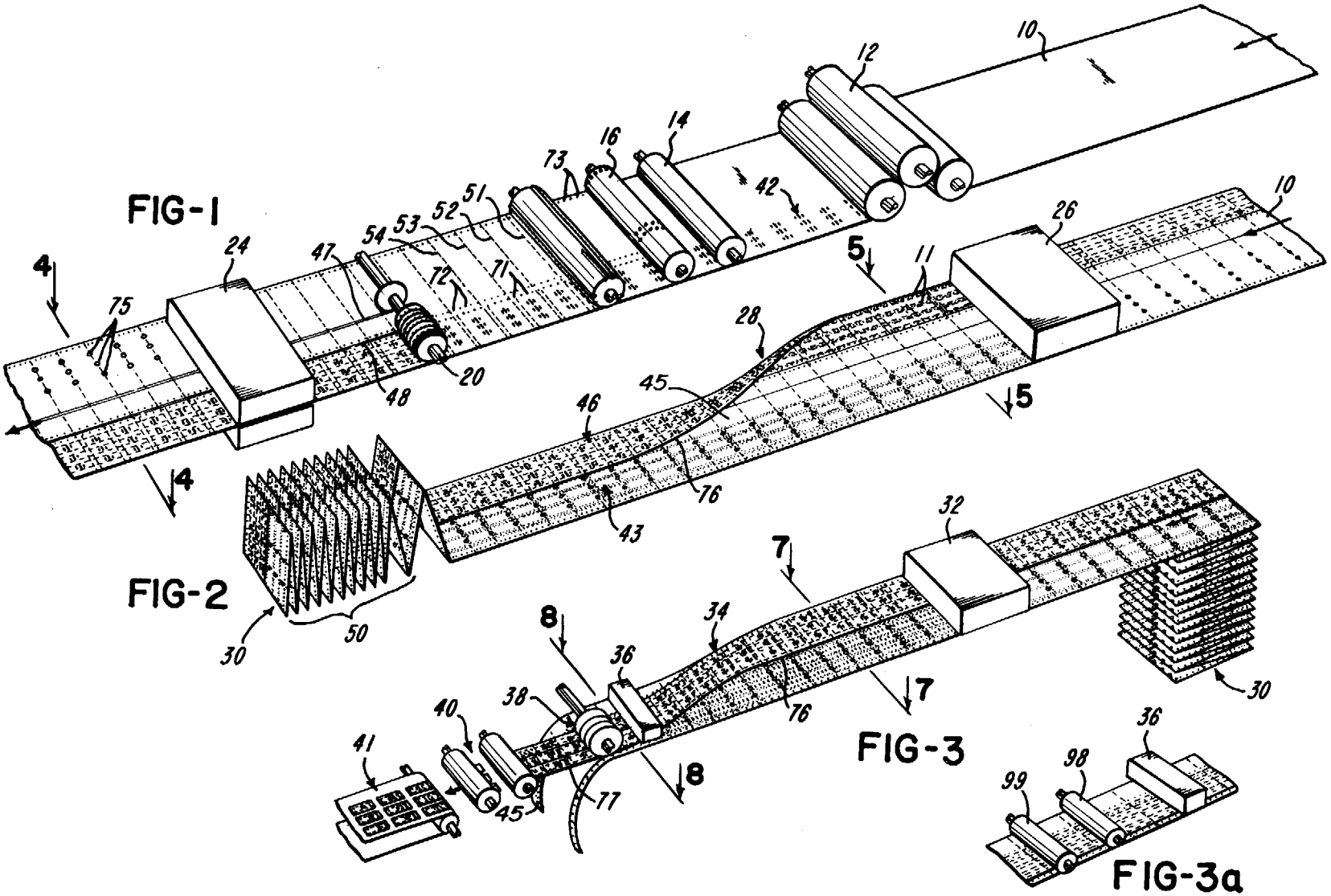
FIGS. 1, 2, and 3 diagrammatically illustrate steps in the method of making the continuous form comprising a series of interconnected blanks, and the articles incorporating the features of the present invention.
FIG. 3*a* is a modification of the process of FIG. 3.

The continuous form of the present invention defines a series of interconnected blanks uniquely designed to receive indicia on both a panel defining the interior or concealed surface of a pocket of a final article and a panel defining the exterior face of the final article. The form is designated generally by the reference numeral 30 as illustrated particularly in FIG. 2. The form in adapted to be subsequently processed into lottery tickets, mailing envelopes or the like wherein the final article includes a sealed pocket for carrying concealed indicia. The present form is unique in that it permits simultaneous application of original, directly applied indicia to an internal surface of the pocket and to face of the article in a single printing procedure.

The steps required to produce the continuous form of the present invention are illustrated generally in FIG. 2 and comprise: (1) continuously advancing a properly prepared endless web of material 10 toward a fold station 28; (2) selectively applying a so-called initially inactive adhesive 11 to a portion of one surface of the web at 26; and (3) folding the web at 28 to generate the continuous form 30 having at least two side-by-side panels wherein the exposed upper surface of one is an exterior face of the final article and the exposed upper surface of the other is an upper interior surface of the article pocket.

The preliminary steps required to prepare the material web 10 are shown generally in FIG. 1 and will vary somewhat depending upon the configuration of the final article. Generally, certain identifying and instructional indicia is applied on either one or both surfaces of the web at printer 12. Inventory control data may be added at station 14, for example, run number, date, form style, or other information. This control data is generally added to discardable portion of the form and is deleted from the final article. One or more continuous series of line holes 71, 72, and 73 may be provided at punch 16. The line holes are adapted to be engaged by sprocket gears or the like, whereby the finished form is advanced through subsequent processing stages. The form is next subdivided into interconnected, transversely spaced length sections at station 18 by scoring or perforating transverse weakened lines 51, 52, 53 and 54 spanning the width of the web, wherein each length section defines at least one complete blank.

It is advantageous to supply any other transverse weakened lines to the web at station 18. Longitudinal weakened lines 47 and 48 divide the continuous web into a plurality of longitudinal, continuous panels which collectively span the width of the web and are provided at station 20. In certain instances it is desirable to provide die cuts 75 in the web. These are supplied in the web at station 24.

While each of these steps are preliminary and may be performed in any order, with certain steps added and other deleted depending only upon the configuration of the final article, it should be understood that certain preliminary preparation of the web 10 is generally required prior to generation of the continuous form 30.

The continuous form 30, as illustrated in FIG. 2, is particularly suited for subsequent processing into multiply envelopes, lottery tickets, or the like having a sealed pocket containing original, concealed, exposable indicia and an exterior face bearing original, directly applied indicia. The continuous form is generated by folding the web at 28, bringing marginal edge 76 toward the center of the web for disposing at least two continuous adjacent non-abutting panels 43 and 46 in side-by-side juxtaposition, each having an upper surface adapted to receive original, directly applied indicia. As can be seen, the upper surface of panel 43 is the upper exposed surface of the continuous web 10, while the upper exposed surface of panel 46 after folding at 28 is the lower surface of the continuous web.

After folding, at station 28, the web may be accumulated at an accumulating station 50, as illustrated in FIG. 2. The web may be either fan or accordion folded as illustrated, stored on a continuous roll, or otherwise stored in any well-known manner.

Subsequent processing steps, illustrated in FIG. 3, produce a final article from the form 30 of FIG. 2 when the continuous form is advanced through a controlled printing process 32 wherein original indicia is simultaneously and directly applied to the exposed upper surfaces of each of panels 43 and 46. The form is then folded at station 34, superposing panel 46 in overlying relationship with panel 43 thereby concealing the indicia contained thereon.

The adhesive coating applied at station 26 forms a permanent seal between and permanently bonds portions of panels 43 and 46 to one another to generate a closed pocket containing concealed, originally applied indicia. One example of an initially inactive adhesive is hot-melt glue of the type having an affinity for the surface of the web 10 when applied at station 26, quickly becoming "inactive" as that term is used herein until reheated by a heat source located at station 36. Glue of this type is applied in an adherent, tacky, heat-liquified state, thereafter cooled to a non-tacky state in which it remains until reheated at station 36. It should be understood that other types of adhesive bonding could be utilized without departing from the spirit of the invention. One such example is known as "self-stick" adhesive, wherein the adhesive, once applied, will not adhere to anything but another coating of the same adhesive. Utilization of this adhesive would require replacement of the heat source at 36 with a nip-roll for applying pressure to the adhesive contact areas. It should be understood that for purpose of the present disclosure and claims, an adhesive of the self-stick type is considered initially inactive, and is said to be activated when making direct contact with another surface having the same adhesive coating.

Panel 45, which is intermediate panels 43 and 46 and forms an interconnection between corresponding edges thereof may be discarded from the continuous form after the glue 11 is activated to bond panels 43 and 46 to one another. Panel 45 and the other excess and marginal regions are removed at 38 and the form is separated into individual articles at 40 for distribution at 41. Thus, continuous form 30 is generated as illustrated in FIG. 2 form a continuous web of material properly prepared as illustrated in FIG. 1. It should be understood that some of the preliminary steps illustrated in FIG. 1 could be performed subsequent to the fold station 28, if desired. The steps subsequent to generation of the continuous form 30 are illustrated in FIG. 3, and are utilized to produce a final article from the form of FIG. 2.

FIGS. 1, 2, and 3 illustrate steps in the method of making the continuous form, the continuous form per se, and in general a final article meeting the objectives of the present invention. By placing at least two adjacent non-abutting continuous panels, such as, by way of example, panels 43 and 46, in side-by-side juxtaposition, wherein one panel defines an exterior face of an envelope, lottery ticket or the like and the other panel defines an interior surface of the pocket thereof it is possible to directly apply original indicia to both the face and the interior pocket of the final article in a single, continuous printing process. The two panels are continuously interconnected, first by discardable panel 45 and subsequently by adhesive 11.

FIGS. 4–30 illustrate various embodiments utilizing the teachings of the present invention as illustrated in FIGS. 1–3. While each of the embodiments vary with respect to detail, the principle is identical, i.e., achieving a final article having directly applied, original indicia on both an exterior face and an interior, concealed surface of the pocket thereof.

A first embodiment of the continuous form 30, produced by utilizing the particular preliminary steps illustrated in FIG. 1, and the resulting article obtained therefrom is illustrated in FIGS. 4–10. While the embodiment therein disclosed includes independent transversely spaced blanks each including three article forms in parallel side-by-side relationship, it should be understood this is merely illustrative and not intended to be restrictive or limiting. The number of forms contained in each blank is limited only by the desired size of the final article.

Figures 4, 5, 6, 7, 8, 9, 9A, 10:
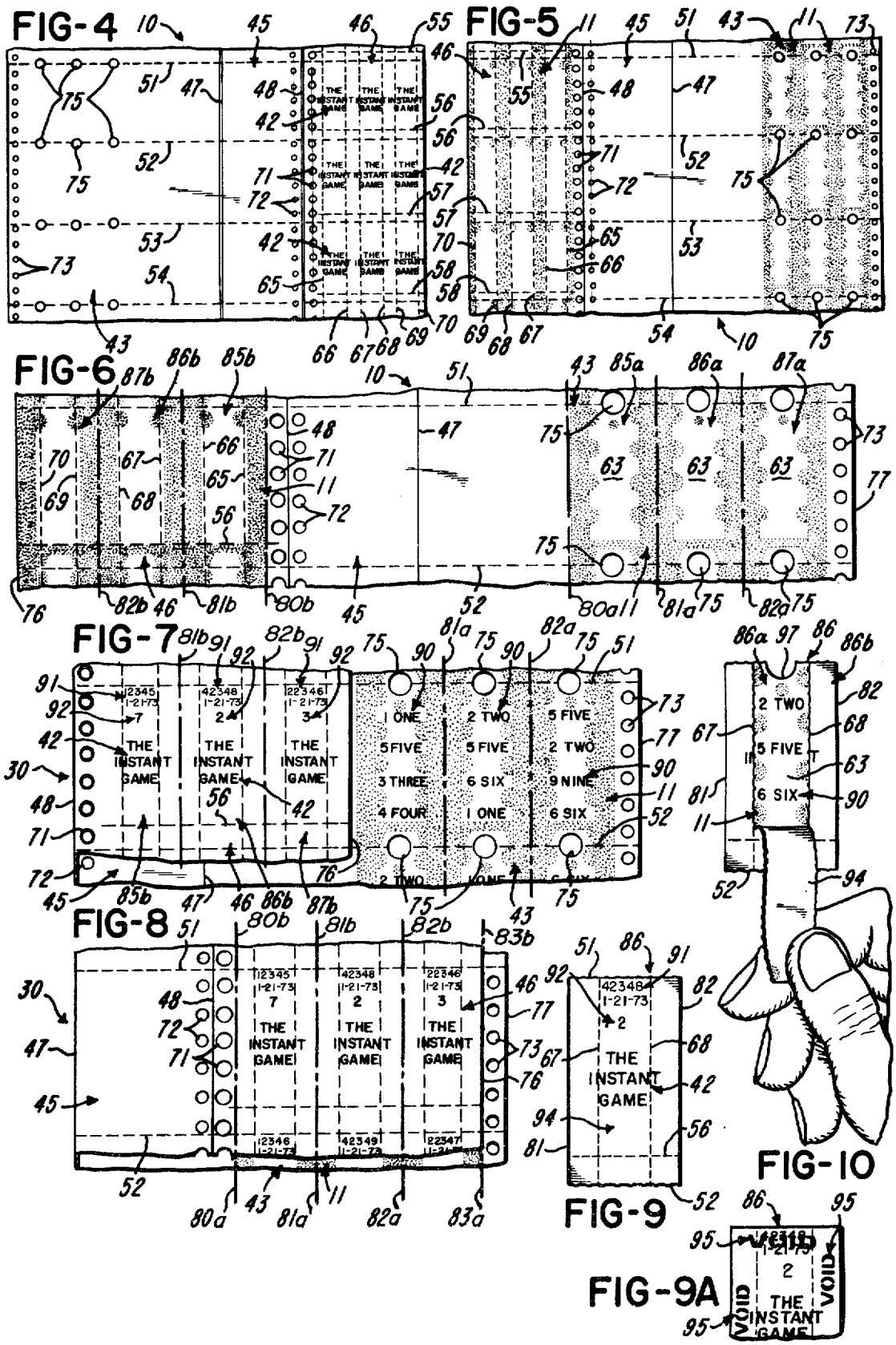
FIGS. 4–10 illustrate the various steps for producing a continuous form by the process of FIGS. 1–3 and a lottery ticket obtained therefrom.

The web 10, as prepared by the steps of FIG. 1, is illustrated in FIG. 4 taken at line 4—4 of FIG. 1. As a matter of convenience, the preliminary steps are performed with the lower-web surface up as illustrated in FIG. 4. The web is then turned over and hot-melt glue or other initially inactive adhesive 11 is applied to the top surface thereof as illustrated in FIG. 5, taken at line 5—5 of FIG. 2.

The web is defined by three continuous panels 43, 45, and 46, which collectively span the width thereof. The panels may be defined by weakened lines, as by line 48 separating panels 45 and 46, or by an imaginary line, as by line **80*a* separating panels 43 and 45. Panel 45 should be at least of a width accommodating the entire width of panel 46, which is folded thereupon, as shown in FIG. 7. While not strictly essential according to the teachings of the invention, if panel 45 were of lesser width, the printable area of panel 43** would be limited.

One blank of the web is illustrated in FIG. 6. The blank is bounded by tear lines 51 and 52 spanning the width of the web. While tear lines 51 and 52 facilitate the separation of the final article from the continuous web, it is not necessary that each blank be defined in this manner. As illustrated, there are three ticket forms in side-by-side relationship defined by panels **85*a*/85*b*, 86*a*/86*b*, and 87*a*/87*b***, respectively, wherein the *a* panels form the bottom plies of each ticket and the corresponding *b* panels form the top plies thereof. Looking particularly at panel **86*a*, it can be seen that region 63 is substantially surrounded by glue 11. Thus, when original indicia 90 is directly applied to region 63, as in FIG. 7, and later concealed by overlying panel 86*b*, see FIG. 8, the indicia is contained in a pocket that is substantially sealed on all four margins by glue 11**, making improper access to the pocket and exposure of the indicia concealed therein impractical and difficult without imparting easily recognizable damage to the article.

The particular glue pattern of the present embodiment is illustrated in FIG. 5 taken at lines 5—5 of FIG. 2, and is shown enlarged in FIG. 6, for clarity of detail and understanding. The glue 11 is applied in a manner similar to that used to print inked indicia, permitting complex patterns to be generated while maintaining close tolerances. Thus, it is possible to substantially surround the periphery of an envelope pocket with adhesive, forming a seal between plies, thereby encasing the concealed indicia. Where self-stick adhesive is utilized, the glue pattern on top panel 46 must match the pattern on panel 43 in order to be effective. However, when hot-melt glue is used the patterns may be varying, applied in the most effective manner, and in fact need only be applied to one of panels 43 or 46. As can be seen, it is only necessary to apply glue to the upper surface of the web, and particularly where hot-melt glue is utilized. It is further only necessary that one marginal panel be partially coated with adhesive to properly seal the final article.

After application of the so-called initially non-adherent adhesive 11, the web is folded along fold line 48 bringing edge 76 toward the center of the web, placing edge-adjacent or outer panel 46 in overlying relationship with intermediate discardable panel 45 to define a form having two continuous, adjacent non-abutting panels in side-by-side relationship wherein the panels collectively span the width of the form. The lower surface of the web 10 is the exposed upper surface of panel 46, and the upper surface of the web is the exposed upper surface of panel 43. By folding in this manner, the upper surfaces of panels 43 and 46 are then placed in side-by-side juxtaposition. This arrangement permits simultaneous application of directly applied, original indicia to each panel at printer 32 and as shown in FIG. 7 taken at line 7—7 of FIG. 3.

Generally, the form 30 is next accumulated at station 50 as shown in FIG. 2, and may be accordion folded, rolled or otherwise accumulated in an endless series of connected blanks. The form is then adapted to be printed, sealed, and separated for distribution as illustrated in FIG. 3.

As illustrated in FIG. 7, original indicia may be simultaneously applied directly to the upper exposed surface of each side-by-side panel 43 and 46. Indicia 90, to be later concealed, is supplied to panel 43 in region 63, while permanently exposed indicia 91 and 92, are supplied to panel 46 which in reality defines an exterior face of the final article.

When means, such as by way of example, *a;* a computer-controlled printer is utilized for printing lottery tickets or the like, marginal sprocket or line holes 71, 72, and 73 are utilized to feed the form through printing station 32. As illustrated in FIG. 7, once the web is folded at line 48 to define the form 30 containing side-by-side panels 43 and 46, holes 71 and 72 are placed in overlying registry. Therefore, holes 71 are of slightly larger diameter than holes 72, thus ensuring their proper alignment when the web is so folded. The holes 72 engage the sprocket teeth of printer 32 while holes 71 serve merely as clearance holes in the top ply of the form. All of the sprocket holes 71, 72, and 73 are contained in marginal, discardable portions of the form 30 and are removed at step 38 of FIG. 3 prior to completion of the final article.

After application of original indicia 90, 91, and 92, the form 30 is again folded at station 34, this time along longitudinal fold line 47. This superposes panel 46 in direct, overlying relationship with panel 43, thereby completely concealing the original, directly applied indicia 90. The adhesive 11 is then activated at 36 by heating or other suitable means to seal the concealed indicia in a closed pocket, as illustrated in FIG. 8. The form 30 is next longitudinally cut or slit at station 38 along phantom lines 80, 81, 82, and 83 to remove the sprocket holes 71, 72, and 73, the interconnecting discardable panel 45, other excess material, and separate the three side-by-side tickets of each length section, as illustrated in FIG. 3. Thus, panel 45 of the original web 10 is completely eliminated from the final article. The final article consists of two-ply construction having panel 46 defining the top bearing original indicia, and panel 43 defining the bottom thereof wherein a closed pocket is defined therebetween, and wherein the pocket contains concealed indicia which is directly and originally applied to panel 43. This continuous series of tickets is then burst apart at boundary lines 51, 52, 53 and 54 to provide individual tickets at 40 for distribution at 41 of FIG. 3.

A typical completed ticket 86 is illustrated in FIG. 9. The ticket there shown consists of bottom ply **86*a* which is a portion of panel 43 and top ply 86*b* which is a portion of panel 46. A tear strip 94 is provided in the top ply 86*b* to provide access to the concealed indicia 90. The tear strip is defined by lines 67 and 68 forming longitudinal parallel tear lines and transverse line 56 which intersects lines 67 and 68, and the top of the ticket 51. The tear strip 94 is located within the boundaries of the peripheral glue pattern, and covers the indicia bearing region 63. As illustrated in FIG. 10, the die cuts 75 define access slots or thumb notches 97 exposing a portion of the underside of the tear strip 94 to facilitate removal thereof. The strip is removed as illustrated in FIG. 10, exposing the concealed indicia 90. If the indicia 92 matches at least one of the concealed indicia 90**, the holder has a winning ticket. The greater the number of matches, the higher the winning value.

A modification of the processing steps illustrated in FIG. 3 is illustrated in FIG. **3*a*. The modification has no visual affect on the completed article, for example ticket 86 illustrated in FIG. 9. However, it is often desirable to provide a tamper-proof ticket, particularly when the form 30 is utilized to produce articles for games of chance, such as in state-supported lottery systems. Thus, when a heat activated or similar gluing technique is utilized, it is critical to ensure that the ticket seal is not subsequently broken by heating the glue to its melting temperature. The modification of FIG. 3*a* provides such a system. A chill-roll 98 is provided after the heat source 36, for cooling the entire form to a temperature substantially below the glue melt temperature. Heat-responsive, normally invisible ink is then applied to the form at station 99. The ink responds to and becomes visible at a temperature somewhat below the melt temperature of the glue. Thus, the final ticket 86 has no visible evidence of the ink, as illustrated in FIG. 9. However, when there is unwarranted tampering by heating in an attempt to melt the glue, the invisible ink is activated, becoming visible as indicia 95, as illustrated in FIG. 9A**, thereby rendering the ticket void.

Thus, the form 30, and the resulting article illustrated in FIGS. 4–10 provide a tamper-proof lottery ticket having directly applied, concealed indicia on both the interior pocket surface and the exterior face of the ticket, suitable for use in state lottery systems or the like.

A second embodiment of the continuous form 30 is illustrated in FIGS. 11–17 and is identical in principle to that of the form in FIGS. 4–10. Elements of the form of FIGS. 11–17 are indicated by numerals in the hundred series and correspond to similar elements in FIGS. 4–10.

The web 110, illustrated in FIG. 11, is prepared by the steps of the process of FIG. 1, turned over and substantially advanced through the process of FIG. 2 to generate the form 130, as illustrated in FIG. 12. The web is separated into three basic panels 143, 145, and 146, wherein fold or tear line 144 separates panels 143 and 145, and wherein line 148 separates panels 145 and 146. Independent blanks are defined as in the previous embodiment by spaced transverse weakened lines, for example lines 151 and 152 bounding the blank illustrated in FIG. 11. As before, indicia 142 may be pre-printed on the form at station 12 of FIG. 1. However, in the present embodiment both sides of the form are preliminarily printed, see FIGS. 11 and 12. In addition to indicia 142, on the upper surface of panel 146, similar indicia 184 is printed on the upper surface of panel 143 in region 163 of each ticket form. Further, an opaque background region 160 is printed on the under surface of panel 143 corresponding to each ticket form. The opaque background is an added security feature of the second embodiment. The background overlies the concealed indicia 190 when the form is folded as in FIG. 13 and prevents transmission of light through the ticket to detect the contents. Line holes 171, 172, and 173 are, as before, included to facilitate the progression of the form through the processing steps.

The particular glue pattern of the second embodiment is illustrated in FIG. 11, and completely surrounds the periphery of each pocket with adhesive 111, for forming a seal between plies, thereby encasing the concealed indicia of the final article. As in the first embodiment, each blank includes three tickets in side-by-side relationship wherein panel 146 comprises the top ply of each ticket and panel 143 comprises the bottom. The ticket blanks are thus defined by panels 185*a*/185*b*, 186*a*/186*b*, and 187*a*/187*b*, respectively, wherein the *a* panel is the bottom ply of each ticket and the corresponding *b* panel is the top ply thereof. Looking particularly at panel 186*a* it can be seen that region 163 is completely surrounded by glue 111. Thus, when original indicia 190 is applied to region 163, see FIG. 12, and later concealed by overlying panel 186*b*, see FIG. 13, the indicia is completely sealed on all for margins by glue 111, making improper access and exposure impractical.

After application of the glue 111, the web is folded along fold line 148, bringing edge 176 over to the center of the web 110, and placing panel 146 in overlying relationship with panel 145. Thus, one surface of panel 143 and one surface of panel 146 is exposed, being disposed in substantially side-by-side juxtaposition, wherein the lower surface of the web 110 is the upper surface of panel 146 and the upper surface of the web is the upper surface of panel 143, permitting simultaneous application of directly applied original indicia to each panel at printer 32.

After the application of indicia 190, 191, and 192 at printer 32, the web is folded along line 147, as shown in FIG. 13, to conceal panel 143 by superposing panel 146 in overlying relationship therewith. The glue is next activated, the excess material is removed along lines 180 and 184, and the individual tickets are separated for distribution. It is often desirable, to provide weaken lines 180, 181, 182, and 183 in the web as a preliminary step, completely defining each blank in an early stage of the process. It should be understood that any of the weakened lines separating the individual blanks from the continuous form could be replaced by subsequent cutting operations.

A unique feature of the second embodiment is the addition of indicia 192 on the upper surface of panel 143, as well as on the upper surface of panel 145, see FIG. 12. As before, the indicia 192 indicates a particular number which must be matched to indicate that the holder has a winning ticket, said number being applied at station 32 of FIG. 3 simultaneously with application of indicia 190 and 191. However, to negate possible loss of the tear strip 194 and lack of proof of the winning combination, the winning number indicia 192 has also been included on the indicia bearing region 163 of each ticket.

The tear strip 194 of the second ticket has been slightly modified in that an added tear line 188 is provided at the top of each ticket to create a window tear strip 194 framed by the remainder of the top ply of each ticket. Thus, glue 111 completely surrounds and frames tear strip 194 and provides a total peripheral seal see FIG. 10, and the access notch 97 of the first embodiment is eliminated.

To open ticket 186 of the second embodiment, see FIGS. 15, 16, and 17, the holder merely bends the ticket at line 188, breaking the ties in tear line 188 and lifting end 193 of the tear strip, see FIG. 16. The strip is then removed as shown in FIG. 17.

Thus, the main distinctions between the embodiment of FIGS. 4–10 and the embodiment of FIGS. 11–17 are the shape of the tear strip 194; the addition of an opaque region 160 contained on the lower surface of 146 in each ticket half 185*b*, 186*b*, and 187*b* corresponding to regions 163 of panel 143; and the inclusion of the winning number indicia 192 on region 163 of each ticket. Again, the modification illustrated in FIG. 3*a* could be here incorporated.

A third embodiment of the present invention is included in FIGS. 18–24. This form is similar in principle to the first and second embodiments. The form of FIGS. 18–24 differs from the earlier embodiments in that fourth and fifth panels have been added, for generating a three-ply ticket. To facilitate the understanding of similarities between the forms, elements of the third embodiment have been indicated with numbers of the two hundred series corresponding to reference numerals of like elements in the previous embodiments.

Panels 278 and 279 have been added in the third embodiment for generating a final ticket of three-ply construction rather than the two-ply ticket of the earlier embodiments. Panel 278 is bounded by line 231 separating it from panel 243, and panels 278 and 279 are likewise separated by line 264. It should be noted that omission of the additional panels would substantially result in the form of the second embodiment. Therefore only the differences will be here discussed in detail.

The web 210, as shown in FIG. 18, is divided into five panels 243, 245, 246, 278, and 279. Fold line 280 separates panels 243 and 245, while fold line 231 separates panels 243 and 278. Fold lines 248 and 289 define the edge-adjacent or outermost panels 246 and 279, respectively. Independent blanks are defined by spaced transverse weakened lines, for example 251 and 252 bounding the blank illustrated in FIG. 18. As in previous embodiments, indicia 242 is supplied at station 12 of FIG. 1 on one or both sides of the form. In the illustrated embodiment, only the underside is printed at 12, supplying indicia 242 to panels 279 and 246. As before, an opaque background region could be added to one side of panel 246 and/or 279, if desired.

Line holes 271, 272, 273, and 296 are supplied to facilitate the progression of the form through the processing equipment. As in previous embodiments holes 271 are of larger diameter than holes 272. Thus, when the web is folded to generate form 230, see FIG. 19, holes 271 serve merely as clearance holes. Holes 273 correspond generally to the marginal line holes spaced along margin 77, see FIG. 6, or margin 177, see FIG. 11, of earlier embodiments, and holes 296 are of larger diameter, forming clearance holes when the web is folded, in the same manner as holes 271.

The glue pattern of the third embodiment is illustrated in FIG. 11, and, as in the second embodiment, completely surrounds the periphery of each pocket with adhesive 211 forming a seal between plies, thereby encasing the concealed indicia. Unlike in the earlier embodiments, each transversely spaced blank includes only one ticket form, generating a three-ply ticket consisting of a top ply or panel 246, a bottom ply or panel 243, and a center ply or panel 279, see FIG. 21. Again, the number of side-by-side ticket forms defined by each blank is strictly a matter of convenience.

Upon application of the glue 211, the blank is folded along longitudinal weakened line 248 bringing edge 276 over to the line 280 of the web 210, placing panel 246 in overlying relationship with panel 245. Panel 279 is likewise brought into overlying relationship with panel 278. Thus, the lower surface of web 210 becomes the upper surface of panels 246 and 279, and the upper surface of the web remains the upper surface of panel 243. By folding in this manner, the upper surfaces of panels 243, 246, and 279 are simultaneously exposed, being in side-by-side juxtaposition. This arrangement permits simultaneous application of directly applied, original indicia to each panel at printer 32 of FIG. 3. In the illustrated embodiment, only panels 243 and 246 are printed at station 32. However, it should be understood any combination of panels 279, 243, and 246 could there receive original indicia.

Another unique feature of the third embodiment is the placement of indicia 292 on the front ply or panel 246 of the ticket. By placing the indicia out of the region of tear strip 294, it is not necessary to repeat the winning number on the pocket surface 263, as it is integral with the ticket structure even after the ticket is opened.

After the indicia 290, 291 and 292 have been supplied to the form of FIG. 19, the form is first folded along line 231 as in FIG. 20, bringing panel 279 into direct, overlying relationship with panel 243 concealing indicia 290. Panel 246 is then folded along line 247 over and onto panel 279, to form the three-ply ticket as shown in FIG. 21. After glue 211 is activated, the excess material is removed along lines 281 and 282 in discarding panels 278 and 245, and the individual tickets are separated from the continuous series of interconnected tickets at lines 251 and 252 to generate the final ticket as shown in FIG. 22.

The third embodiment includes "U" shaped, hinged tear strips 294 and 274 which are not completely removed from the ticket upon opening, see FIG. 24. Strip 294 is hinged at the bottom while strip 274 is hinged at the top of the final ticket, as illustrated. Thus, two distinct acts are required to completely open the ticket, rendering accidental opening unlikely. Strip 294 is provided by supplying line 267, 268, and 293 is preliminary steps 18 and 20. Strip 274 is likewise provided by supplying lines 265, 266, and 256 at steps 18 and 20. It will be noted, see particularly FIG. 23, that strip 294 is narrow relative to strip 274, thus ensuring against unwarranted tampering and accidental opening. However, once strip 294 is opened as shown in FIG. 24, strip 274 may be likewise removed to expose the concealed indicia 290.

Still another embodiment of the present invention is illustrated in FIGS. 25–30 and comprises a form defining a series of connected evelope blanks for generating mailing envelopes containing concealed indicia to be exposed by opening the envelope upon receipt. Elements corresponding to similar elements of earlier embodiments are given like numbers in the three hundred and four hundred series.

As in the first and second embodiments, web 310 is separated into three panels, 343, and 345 and 346. Panels 345 and 346 are bounded by fold line 348, and panels 345 and 343 are bounded by fold line 381.

Both surfaces of the web are pre-printed at station 12 of FIG. 1. Indicia 342 is added on the reverse surface, see FIG. 26, and may include for example the return address, a postage permit, and instructions indicating how the envelope may be opened. The indicia 410 on the front surface, as illustrated in FIG. 25, is confined to panel 343 and may include standard invoice information as shown, which will not vary with respect to the addressee.

Figure 25:
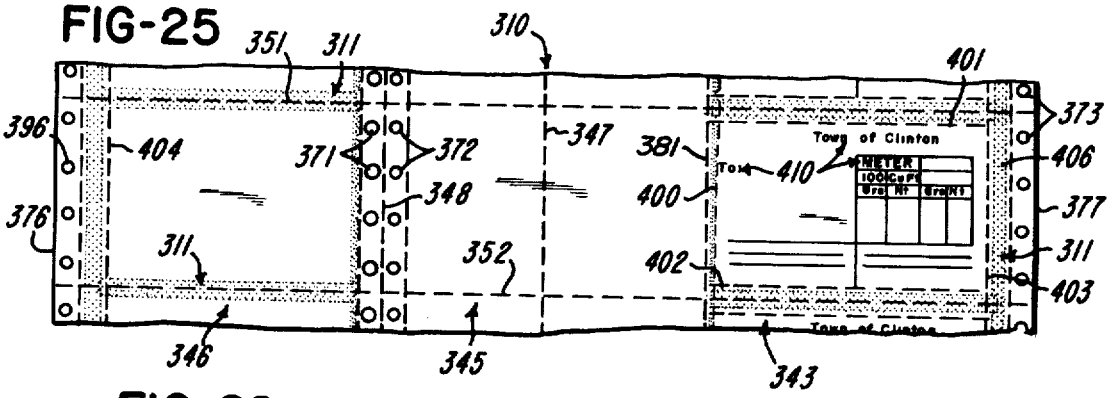
FIGS. 25–30 illustrate the various steps for producing a fourth continuous form by the process of FIGS. 1–3 and the mailing envelope obtained therefrom.

The web is separated into a series of connected, transversely spaced blanks, wherein each blank contains one envelope form bounded by transverse weakened lines, for example lines 351 and 352 as illustrated in FIG. 25. Line holes 371, 372, 373, and 396 are provided to facilitate progress of the envelope through the processing equipment. As in earlier embodiments, the number of envelope forms contained in each blank is strictly a matter of convenience.

Figure 27:
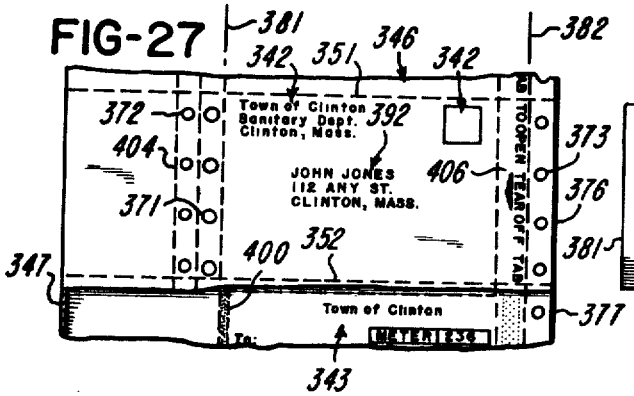
Figure 28:
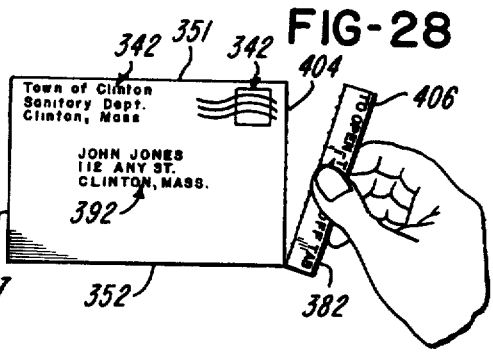

The pattern of adhesive 311 is illustrated in FIG. 25 and as a marginal band extending about the periphery of both panels 343 and 346 to form a completely sealed pocket when the final envelope is generated, as shown in FIGS. 27 and 28. It should be noted that there are identical glue patterns on those panels which are placed in corresponding registry when the panels are folded into overlying relationship. Where hot-melt glue is utilized only one panel need be coated with adhesive, instead of both as here shown.

Figure 26:
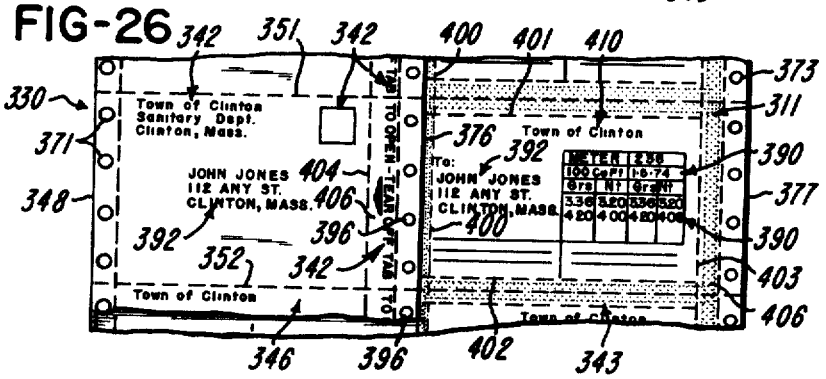

After adhesive 311 is applied, the web is folded to generate continuous form 330 as illustrated in FIG. 26 and is prepared for application of originals indicia, for example the addressee 392 and individualized invoice information 390. Addressee 392 is duplicated on both panels 343 and 346.

Once the indicia 390 and 392 have been applied at station 32 of FIG 3, the form is folded along line 348, bringing panel 346 into direct, overlying relationship with panel 343 for concealing the indicia contained thereon, as illustrated in FIG. 27. The glue is next activated, completely sealing the indicia on panel 343 in a closed pocket. Each envelope is then separated from the continuous series at lines 351 and 352 and excess material, including discardable panel 345, is removed along lines 381 and 382, generating the final envelope as illustrated in FIG. 28.

Tear lines 400, 401, 402, 403, and 404 are provided in web 310 in a preliminary step of FIG. 1 for opening the envelope and exposing the concealed indicia, see FIG. 25. Each tear line 400–403 is adjacent a margin of the web panel 343 and spaced inward from glue 311. Tear line 404 is adjacent line edge 376 of panel 346 and spaced inward from glue 311. When panel 346 is superposed in overlying relationship with panel 343, as illustrated in FIG. 27, edges 376 and 377 correspond as shown and lines 403 and 404 are placed in registry, thereby generating tear strip 406.

Figure 29:
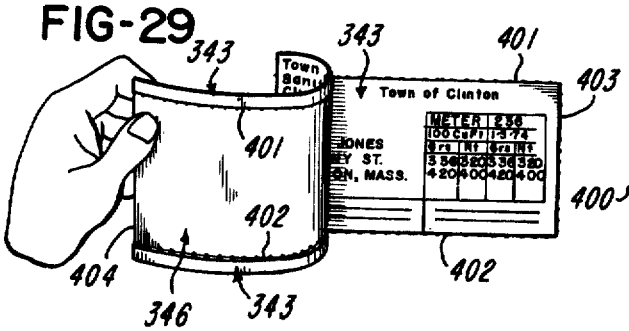
Figure 30:
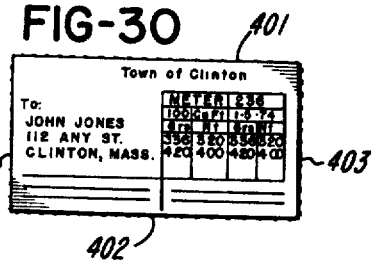

When the envelope of FIG. 28 is received by the addressee, only tear strip 406 need be removed to break the seal generated by glue 311, as illustrated in FIG. 28, thereby providing access to the envelope pocket. Panel 343 may then be exposed by separating it from the envelope along tear lines 400, 401, and 402 as shown in FIGS. 29 and 30.

SUMMARY

From the foregoing, it will be noted that I have provided a family of continuous forms each defining envelopes, lottery tickets or like articles wherein originally applied indicia can be applied to the face and to the pocket of the final, resulting article in a single, simultaneous printing process. Each blank is delimited by various tear lines to provide means of separating it from the continuous series. While each of the forms disclosed vary in detail, illustrating various features of the invention, all are generated from the steps of the process of FIG. 2 with the addition of certain preliminary steps as illustrated in FIG. 1.

The final articles produced from the forms disclosed are each obtained by the steps of the process of FIG. 3 with or without the inclusion of the modifications as illustrated in FIG. *3a*. Each form incorporates patterned gluing to generate a complete or substantially complete seal between the article plies, generating a concealed pocket therebetween, wherein tear lines are provided inward of the seal to provide for exposure of the concealed indicia.

A continuous form having initially three longitudinal panels and a continuous form having initially five longitudinal panels are provided. The three panel form generates a family of articles of two-ply construction while the five panel form generates three-ply articles. The form is generated from a web having an odd number of longitudinal panels spanning the width thereof wherein the adjacent, non-abutting panels including each edgeadjacent panel generate the various plies of the final article, said panels interconnected by intermediate, discardable panels. At least one of the edge-adjacent panels is folded onto and disposed in overlying relationship with an intermediate discardable panel, and in juxtaposed relationship with an adjacent, non-abutting panel, generating a form having side-by-side upper exposed surfaces adapted to receive original, directly applied indicia, wherein the lower surface of the web is the upper exposed surface of the folded panel and the upper surface of the web is the upper exposed surface of the adjacent non-abutting panel.

Specifically, when a three panel web is utilized, for example, the web of FIGS. 4–10, panel 46 is folded onto panel 45 and in side-by-side juxtaposition with panel 43 wherein both panels 43 and 46 have exposed upper surfaces adapted to receive indicia. Panel 46 is then superposed upon panel 43 for generating the final article, panel 45 being discarded. When a five-panel web is utilized, for example, the web of FIGS. 18–24, both edgeadjacent panels 279 and 246 are folded onto their respective intermediate panels 278 and 245, and jointly in side-by-side juxtaposition with adjacent, non-abutting panel 243 wherein panels 279, 243, and 246 have upper exposed surfaces adapted to receive indicia. Panel 279 is then superposed on panel 243, and panel 246 is superposed on panel 279 for generating the final article, panels 278 and 245 being discarded.

While each of the disclosed embodiments incorporates various features of the invention, it should be understood that these embodiments could be combined to produce still other articles varying in detail but identical in principle to the articles disclosed. Further, it should be understood that the method, continuous forms and articles here disclosed are merely illustrative and are not intended to restrict the spirit of the invention or limit the scope of the appended claims.

In FIG. 11, the numeral 160 designates an opaque backround for preventing transmission of light through a ticket to detect the contents thereof. It should be understood that any suitable light barrier, such as, by way of example, metal foil or a friction removable rubber-like material may be utilized in conjunction with and/or in lieu of the background region 160. A suitable friction removable opaque rubber-like material may comprise a water-base, self-stick, cohesive-adhesive material which contains a suitable opaque material, such as, by way of example, black powdered dye capable of providing an effective light barrier which can easily be removed from an opened ticket by rubbing.

It should, of course, be understood that a suitable light barrier material may, if desired, be applied to an adjacent overlying or underlying surface of that ply of the lottery ticket which contains indicia which is to be concealed from everyone but the purchaser of the lottery ticket.

What is claimed is:

1. As a new article of manufacture, a continuous series of interconnected blanks having at least one double ply portion in side-by-side juxtaposition with a single ply portion and suited for subsequent processing into individual envelopes, lottery tickets or like articles each containing original directly applied indicia, comprising an endless web initially having an uneven number of continuous, connected single-ply panels spanning the width thereof, said panels including at least one pair of adjacent, non-abutting panels and an interconnecting intermediate discardable panel connecting said non-abutting panels together, with the outermost of said nonabutting panels forming edge-adjacent panels of said endless web, a foldline defined on said discardable panel between the edges thereof to extend longitudinally of said web continuously for essentially the entire length of said web, said double ply portion being defined by one edge-adjacent panel in overlying relationship with an adjoining intermediate discardable panel and in side-by-side juxtaposition with an adjacent, non-abutting panel which defines said single ply portion; and an adhesive on that surface of the edge-adjacent panel of said double ply portion which is presented toward and overlies the intermediate discardable panel of said double ply portion, said adhesive being non-adherent to the surface of said intermediate, discardable panel.

2. An article of manufacture as called for in claim 1, wherein the adhesive comprises a heat-liquifiable hot melt glue.

3. An article of manufacture as called for in claim 1, wherein the adhesive is a self-stick adhesive which is adherent only to another surface having a like self-stick adhesive thereon.

4. An article of manufacture as called for in claim 1, wherein a pattern of self-stick adhesive is provided on that surface of an edge-adjacent panel which is disposed in overlying contacting relationship with a surface of an intermediate, discardable panel, and wherein a corresponding pattern of self-stick adhesive is provided on the upper surface of said single ply portion.

5. An article of manufacture as called for in claim 1, wherein the endless web includes a double-ply portion along one side edge thereof in side-by-side juxtaposition with said singleply portion.

6. An article of manufacture as called for in claim 1, wherein the endless web includes a pair of double ply portions each in side-by-side juxtaposition with a central single ply portion.

7. An article of manufacture as called for in claim 6, wherein each of said double ply portions are defined by an edgeadjacent panel disposed in overlying relationship with an adjacent, intermediate discardable panel, and wherein said single ply panel is defined by a central panel the opposite side edges of which are integral with an edge of the intermediate discardable panel of a two ply portion.

8. An article of manufacture as called for in claim 1, wherein the endless web comprises a pair of edge-adjacent panels each of which are disposed in overlying relationship with an adjacent, intermediate, discardable panel, and a central panel between and spanning said intermediate, discardable panels, wherein each pair of adjacent, non-abutting panels which are interconnected by an intermediate, discardable panel are defined by an edge-adjacent panel and the central panel.

9. An article of manufacture as called for in claim 8, wherein the upper surface of the central panel is provided with an adhesive which is non-adherent to surfaces of the intermediate, discardable panels.

10. An article of manufacture as called for in claim 1, wherein the non-abutting panels comprise the top and bottom plies of the article, wherein the top and bottom plies have original indicia applied directly to an upper surface thereof and wherein the adhesive permanently interconnects abutting marginal portions of said top and bottom plies defining a closed pocket area therebetween wherein the original indicia on the bottom ply is disposed within said pocket area, and means in one or the other of said plies providing access to the interior surfaces of said pocket area.

11. An article as called for in claim 1, wherein the adhesive comprises a hot melt glue which liquifies at a certain temperature, thereby rendering said article tamper-proof.

12. An article as called for in claim 11, which includes normally invisible heat-responsive means on at least one of said plies which means are rendered visible when and after being heated to a temperature below the temperature at which the said hot melt glue liquifies, said last mentioned means providing easily discernable and unmistakable evidence that the article was reheated to reliquify the hot melt glue.

13. An article as called for in claim 12, wherein said normally invisible heat-responsive means comprises an ink like substance.

14. The article of manufacture as called for in claim 1, further including adhesive means on said non-abutting panels for permanently bonding said panels together to define a concealed area and tear lines defined on at least one of said non-abutting panels for defining an access area thereon, said adhesive bordering said access area.

15. The article as called for in claim 14, further including original indicia applied directly to an upper surface of each of said non-abutting plies, wherein indicia on one of said plies is disposed to be within said concealed area.

16. The article as called for in claim 14, further including tear lines on said non-abutting panels defining pull tabs.

* * * * *